US009260285B2

(12) United States Patent
Luebbers

(10) Patent No.: US 9,260,285 B2
(45) Date of Patent: Feb. 16, 2016

(54) TOTE BAG BEVERAGE DISPENSING APPARATUS

(71) Applicant: Tracey Murray Luebbers, Lake Wylie, SC (US)

(72) Inventor: Tracey Murray Luebbers, Lake Wylie, SC (US)

( * ) Notice: Subject to any disclaimer, the term of this patent is extended or adjusted under 35 U.S.C. 154(b) by 0 days.

(21) Appl. No.: 14/502,569

(22) Filed: Sep. 30, 2014

(65) Prior Publication Data

US 2015/0097000 A1 Apr. 9, 2015

Related U.S. Application Data

(60) Provisional application No. 61/887,179, filed on Oct. 4, 2013.

(51) Int. Cl.

| | |
|---|---|
| ***B67D 3/00*** | (2006.01) |
| ***A45C 11/20*** | (2006.01) |
| ***A45F 3/20*** | (2006.01) |

(52) U.S. Cl.

CPC ..... *B67D 3/0083* (2013.01); *A45C 11/20* (2013.01); *A45F 3/20* (2013.01); *A45F 2200/0583* (2013.01); *B67D 3/0061* (2013.01); *B67D 2210/00131* (2013.01)

(58) Field of Classification Search

CPC ..... B67D 3/0083; B67D 3/0061; B67D 2210/00131; B65D 29/00; A45C 1/00; A45C 11/20; A45F 3/00; A45F 3/20; A45F 2200/0583

USPC ..... 222/105, 175, 192, 465.1; 224/148.1–148.7; 383/110, 906

See application file for complete search history.

(56) References Cited

U.S. PATENT DOCUMENTS

| | | | | |
|---|---|---|---|---|
| 2,013,358 | A * | 9/1935 | Osborne | 224/148.2 |
| 4,375,828 | A * | 3/1983 | Biddison | 383/41 |
| 4,420,097 | A * | 12/1983 | Motsenbocker | 222/131 |
| 4,940,173 | A * | 7/1990 | Jacober | 224/153 |
| 5,005,679 | A * | 4/1991 | Hjelle | 190/110 |
| D340,351 | S * | 10/1993 | Wrath | D3/217 |
| 6,536,637 | B1 * | 3/2003 | McLaughlin | 224/148.3 |
| 6,722,533 | B2 * | 4/2004 | Skillern | 222/175 |
| 6,966,464 | B2 * | 11/2005 | Betkowski et al. | 222/192 |
| D547,545 | S * | 7/2007 | Boehm et al. | D3/202 |
| D585,705 | S * | 2/2009 | Weers et al. | D7/607 |
| 8,430,284 | B2 * | 4/2013 | Broadbent et al. | 224/148.4 |
| 2007/0051752 | A1 * | 3/2007 | Lapins | 222/168 |

* cited by examiner

*Primary Examiner* — Nicholas J Weiss
(74) *Attorney, Agent, or Firm* — Dale J. Ream

(57) ABSTRACT

A tote bag beverage dispensing apparatus includes a housing having upper and lower portions. The upper portion includes bottom and upstanding side walls that define an interior area for carrying articles and an open top for access thereto. The lower portion includes insulated bottom and upstanding side walls defining a compartment and defining a slot for access thereto. The compartment is configured to receive a bladder of liquid having a dispensing nozzle and is insulated for maintaining a temperature of a bladder of liquid, such as a beverage, placed therein. One side wall of the lower portion defines an aperture configured to receive the dispensing nozzle of the bladder of liquid therethrough. The slot transitions between a closed configuration blocking access to the compartment and an open configuration allowing access to the compartment. A flap coupled to the lower portion conceals the opening and the dispensing nozzle.

6 Claims, 7 Drawing Sheets

TOTE BAG BEVERAGE DISPENSING APPARATUS

REFERENCE TO RELATED APPLICATIONS

This application claims the benefit of provisional patent application U.S. Ser. No. 61/887,179 filed Oct. 4, 2013 titled "Tote bag that holds a bag of wine or any liquid contained in a plastic bladder keeping it concealed and cool. The Bag/invention will be called a "SWANKY."

BACKGROUND OF THE INVENTION

This invention relates generally to beverage carrying and dispensing devices and, more particularly, to a tote bag suitable for carrying non-beverage items having a beverage dispensing assembly.

Boxed wine products and other liquids to be dispensed are difficult to carry between locations and to keep chilled. Boxed wine usually includes a plastic bladder situated inside a box and that includes its own dispensing nozzle. Accordingly, beverages like boxed wine are typically not transported to remote locations but, rather, are typically confined to a countertop of one's home. In addition, tote bags for carrying non-food and beverage items are not suitable for carrying or dispensing boxed wine or other large beverage containers.

If boxed wine or other large beverage container is transported in a bag or carrying container, the box, bladder, or container cannot easily be concealed which even though the user may desire that other people not scrutinize or even be aware that the beverage is being transported.

Various devices are known in the prior art for carrying non-food and beverage items, such as generic tote bags, and devices are known for keeping beverages chilled until use, such as insulated coolers. Although assumably effective for their intended uses, the existing devices do not provide a container having an upper portion configured to carry non-food and beverage items and a lower portion configured to carry a beverage of type having a dispensing nozzle in such a way that the bladder is concealed except when the liquid therein is dispensed.

Therefore, it would be desirable to have a tote bag beverage dispensing apparatus that has the appearance and functionality of a tote bag while carrying the bladder of a beverage liquid that can be selectively revealed and dispensed. Further, it would be desirable to have a tote bag beverage dispensing apparatus that can keep the liquid bladder chilled while being transported in the tote bag. In addition, it would be desirable to have a tote bag beverage dispensing apparatus that is fashionable in appearance and conceals that a bagged beverage item is being transported or can be dispensed from.

SUMMARY OF THE INVENTION

A tote bag beverage dispensing apparatus according to the present invention enables a variety of items to be carried in one portion while carrying and dispensing a beverage from another portion, the second portion being distinct and clandestine from the first portion. The apparatus includes a housing having upper and lower portions. The upper portion includes bottom and upstanding side walls that define an interior area for carrying articles and an open top for access thereto. The lower portion includes insulated bottom and upstanding side walls defining a compartment and a slot for access thereto. The compartment is configured to receive a bladder of liquid having a dispensing nozzle and is insulated for maintaining a temperature of a bladder placed therein.

One side wall of the lower portion defines an aperture configured to receive the dispensing nozzle of the bladder of liquid therethrough. The upper portion includes a flap hanging down from one side that is configured to selectively conceal the dispensing nozzle extending through the opening in the lower portion of the housing.

Therefore, a general object of this invention is to provide a tote bag beverage dispensing apparatus that has an upper portion configured to carry non-beverage items and has the appearance of a fashionable bag.

Another object of this invention is to provide a tote bag beverage dispensing apparatus, as aforesaid, that has a lower portion with a compartment for storing a beverage bladder having a dispensing nozzle for dispensing the bagged liquid.

Still another object of this invention is to provide a tote bag beverage dispensing apparatus, as aforesaid, in which the upper "tote bag" portion substantially conceals the stored beverage bladder.

Yet another object of this invention is to provide a tote bag beverage dispensing apparatus, as aforesaid, in which the lower portion has an insulated construction that is capable of keeping a beverage bladder chilled.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
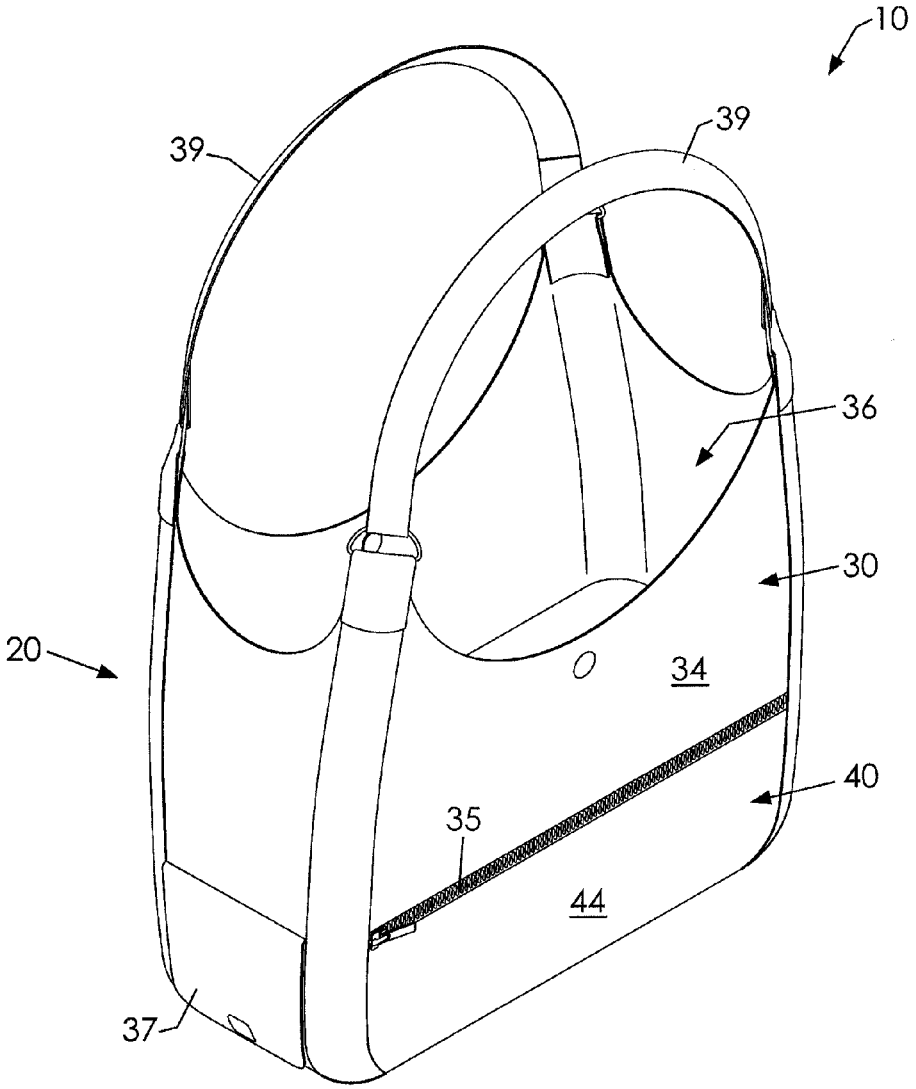
FIG. 1 is a perspective view of a tote bag beverage dispensing apparatus illustrated with a concealment flap in a covering configuration.
Figure 2:
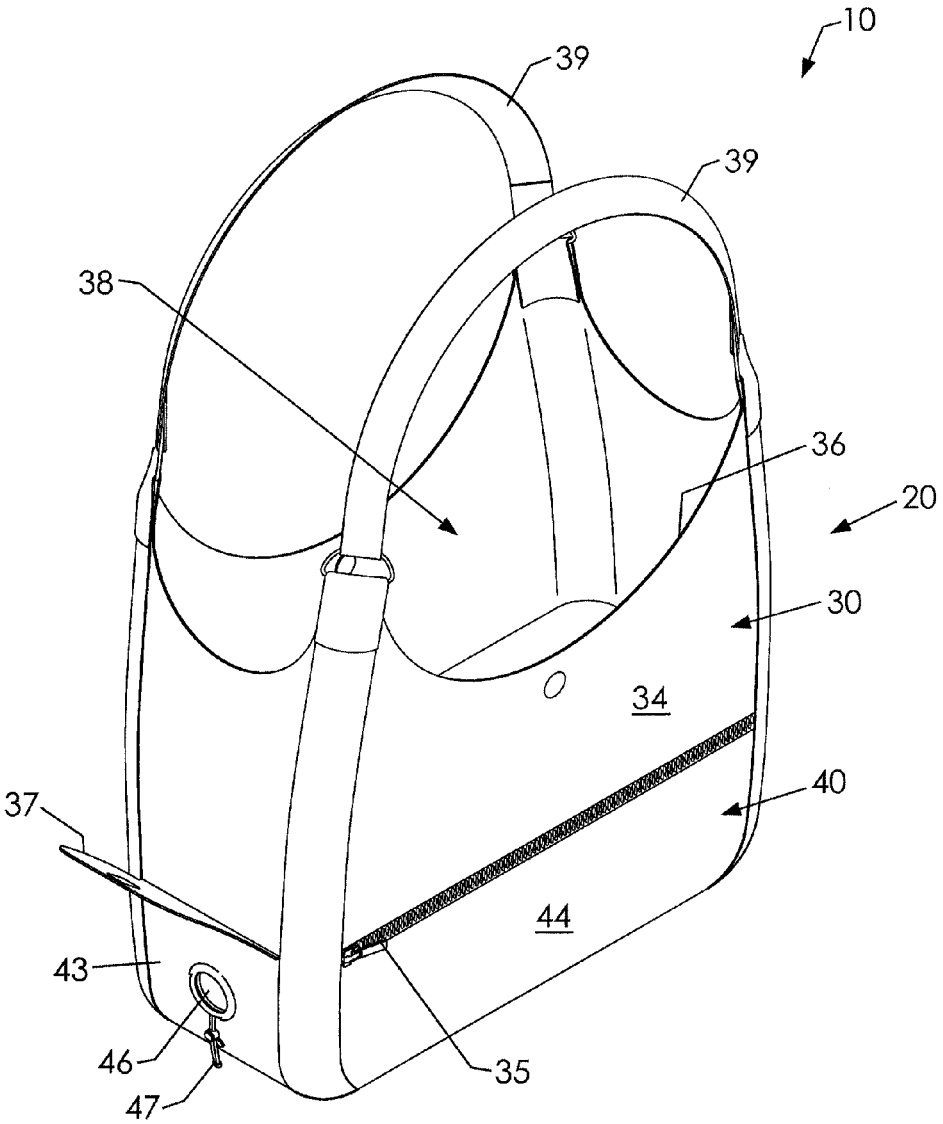
FIG. 2 is another perspective view of the apparatus as in FIG. 1 with the concealment flap in a raised configuration.
Figure 3:
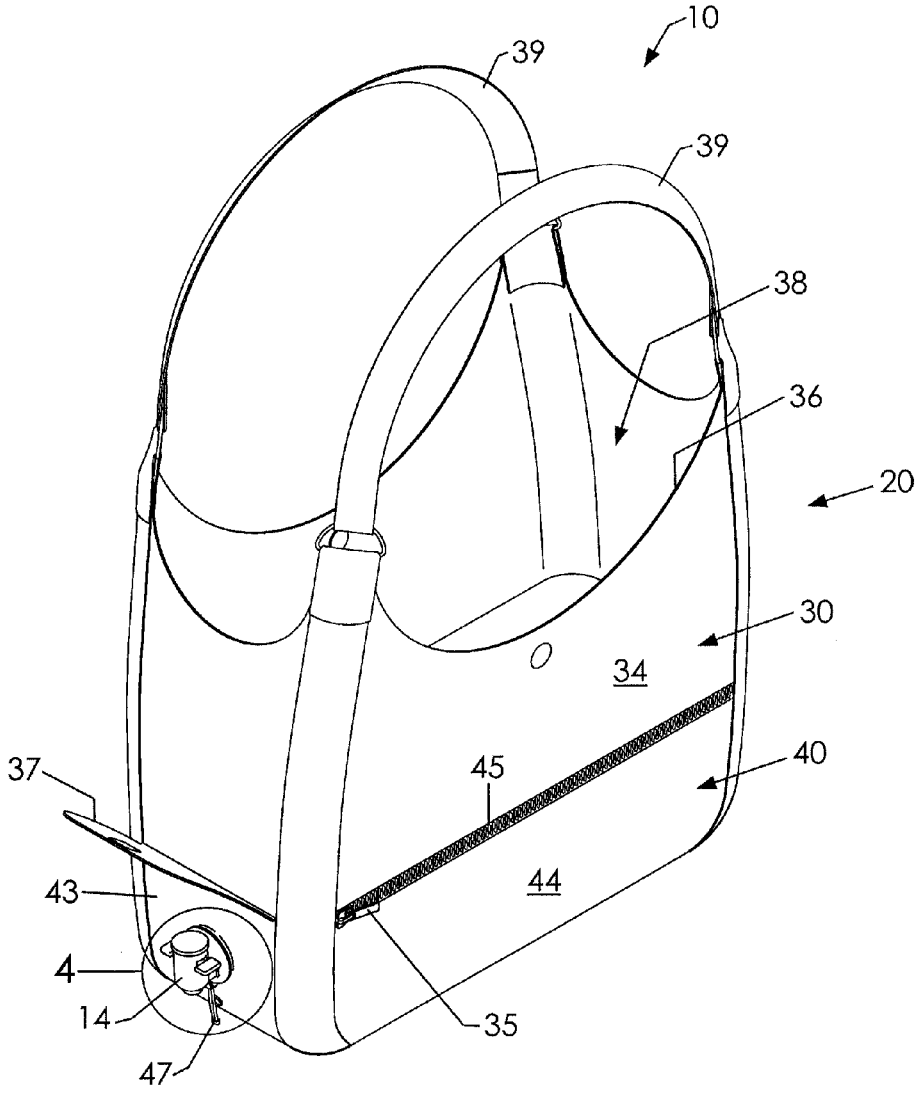
FIG. 3 is a perspective view of the apparatus as in FIG. 2 with a dispensing nozzle extended through a housing side wall and the concealment flap in a raised configuration.
Figure 4:
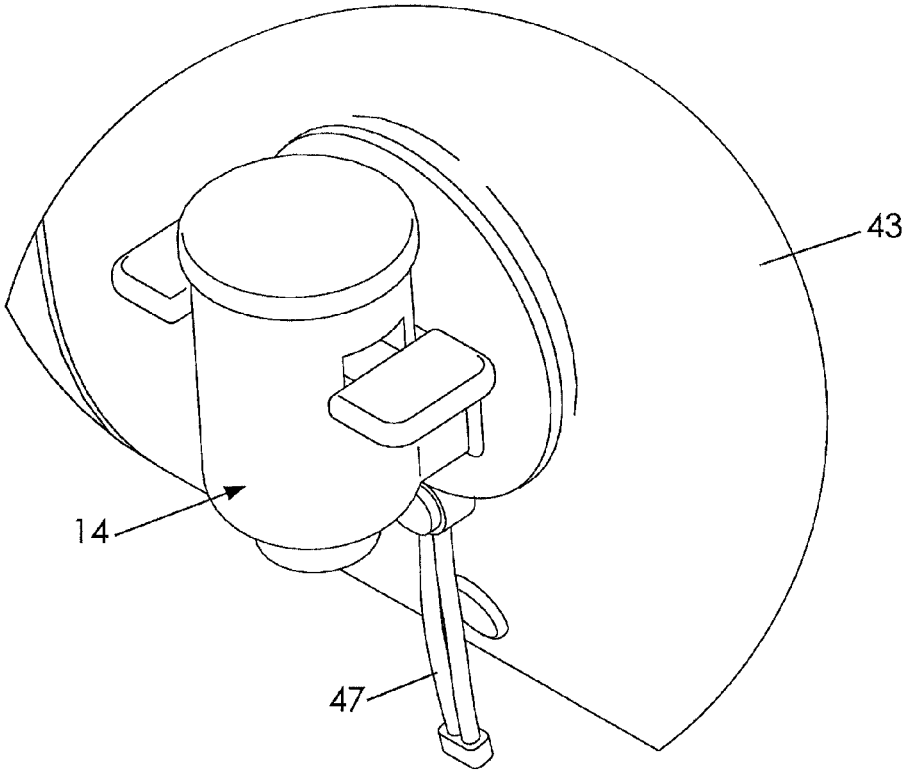
FIG. 4 is an isolated view on an enlarged scale taken from a portion of FIG. 3.

A tote bag beverage dispensing apparatus according to a preferred embodiment of the present invention will now be described with reference to FIGS. 1 to 7 of the accompanying drawings. Specifically, the tote bag beverage dispensing apparatus 10 includes a housing 20 having a lower portion 40 and upper portion 30 for use with a bladder 12 of liquid, such as a beverage having a dispensing nozzle 14.

The lower portion 40 of the housing 20 is constructed to contain and insulate a bladder 12 of liquid, such as wine, tea, water, or other beverage desired by a user. The upper portion 30 of the housing 20 is configured to hold various articles, such as would be common to carry in a purse or tote bag. For example, the upper portion 30 is configured to hold items such as a wallet, keys, books, towels, electronic or communication devices, and the like.

Specifically, the upper portion 30 includes a bottom wall 32 and at least one but preferably a plurality of upstanding side walls 34 extending upwardly from a peripheral edge of the bottom wall 32. Together, the bottom wall 32 and upstanding side walls 34 of the lower portion 40 of the housing 20 define an interior area and an open top 36 that provides access to the interior area 38. The interior area 38 is spacious and configured to contain items such as those listed above although not limited thereto.

The upper portion 30 of the housing 20 may be constructed of a flexible and fashionable material, such as a fabric, light vinyl material, or the like. The fabric material may include various patterns or indicia. The side walls may be configured in a shape that is fashionable and that is not indicative of a cooler or other container associated with storing food or beverages.

By contrast, the lower portion 40 of the housing 20 has an insulated construction that is able to contain a bladder 12 containing a liquid, such as wine or the like. The lower portion 40 includes an insulated bottom wall 42 and at least one but preferably a plurality of insulated walls extending upwardly from the insulated bottom wall 42. Specifically, a pair of opposed end walls 43 extend upwardly from the bottom wall 42. In addition, a pair of side walls 44 extends upwardly from the bottom wall 42 and extends between the opposed end walls 43. Together, the insulated bottom wall 42, insulated end walls 43, and insulated side walls 44 define an insulated compartment 48 that is capable of maintaining a temperature—warm or cold—of the liquid filled bladder placed therein. The lower portion 40 may be substantially constructed of a polystyrene material known for its insulation qualities or another material having such properties. The compartment 48 is not accessible from inside the interior area 38 of the upper portion 30.

Figure 5:
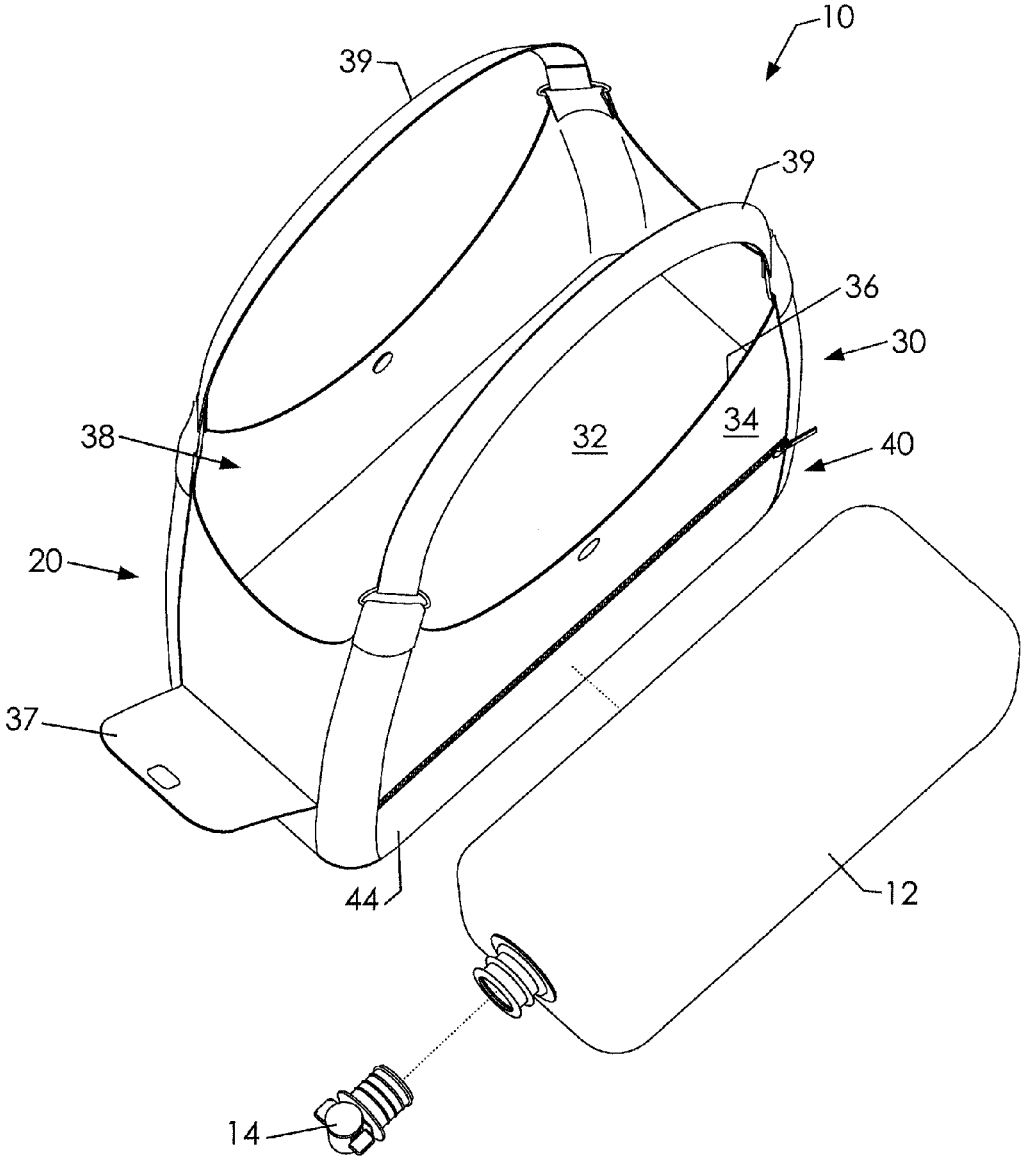
FIG. 5 is an exploded view of the apparatus as in FIG. 1.
Figure 6:
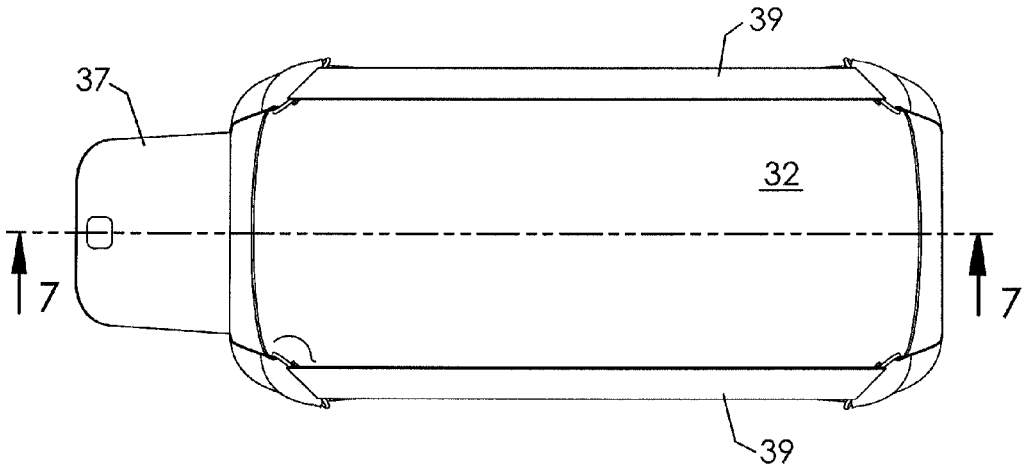
FIG. 6 is a top view of the apparatus as in FIG. 1.
Figure 7:
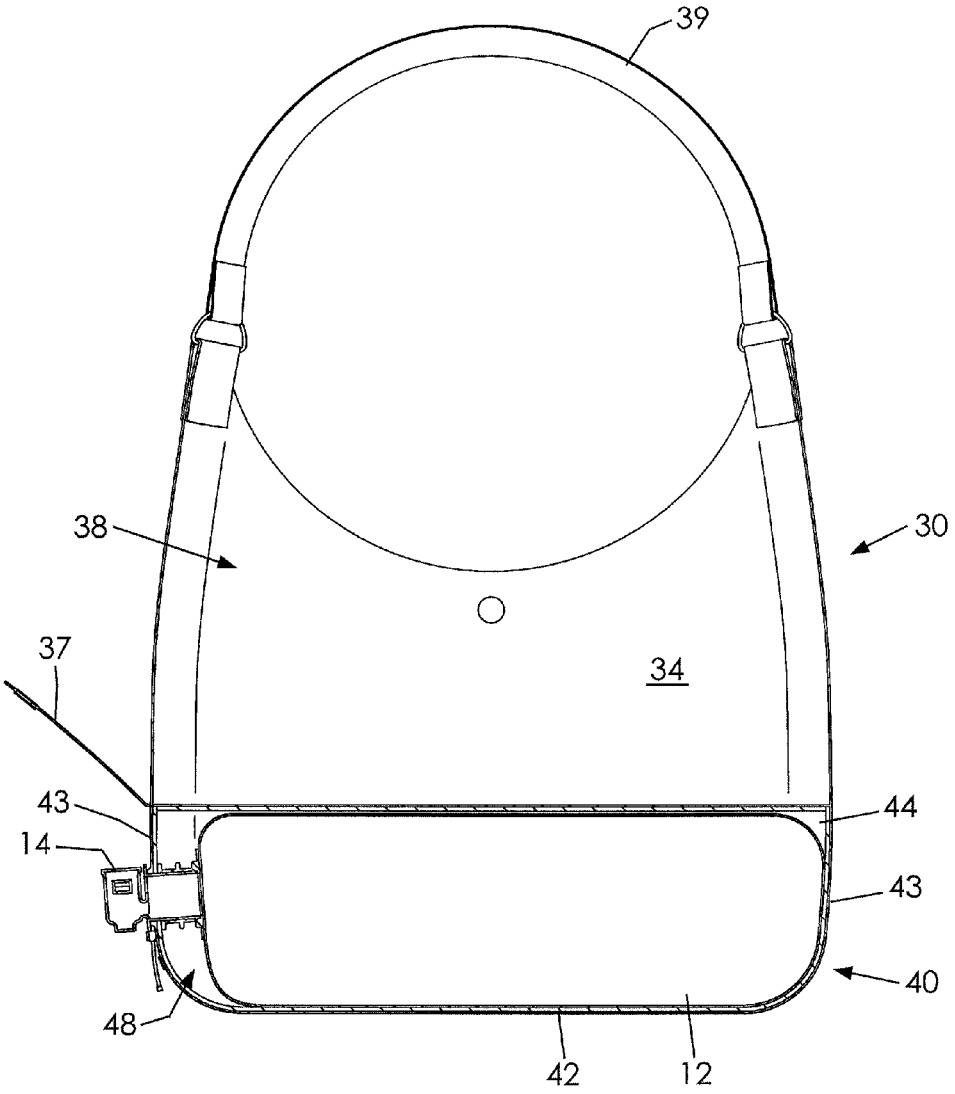
FIG. 7 is a sectional view taken along line 7-7 from FIG. 6.

The front side wall 44 of the lower portion 40 defines a slit 45 extending substantially between the end walls 43 (FIG. 5). The slit 45 is configured to provide access to the compartment 48. Specifically, the slit 45 is dimensioned to receive the liquid bladder 12 into or from the compartment 48. The lower portion 40 includes a fastener 35 in communication with the slit 45 that selectively transitions the slit 45 between an open configuration allowing access to said compartment (FIG. 5) and a closed configuration not allowing access to said compartment (FIG. 1). Preferably, the fastener 35 is a zipper that is easily and quickly moved laterally to obtain or restrict access to the compartment 48 although other fasteners may also work, such as a hook and loop fastener combination, snaps, elastic, or the like. When the slit 45 is open, the bladder 12 may be inserted or removed.

One end wall 43 of the plurality of upstanding walls of the lower portion 40 of the housing 20 defines an aperture 46 that is dimensioned and shaped to receive the dispensing nozzle 14 of a bladder 12 of liquid that is situated within the lower portion 40. The bladder 12 of a beverage liquid, such as a bladder from a wine box, may include its own dispensing nozzle 14 which may be inserted through the aperture 46 and be accessible to a user to dispense the liquid on demand, the aperture 46 having a dimension and configuration that allows the dispensing nozzle 14 to pass therethrough.

In one embodiment, the one end wall 43 may include an elastic material extending across the aperture 46 that defines a slot through which the dispensing nozzle 14 is selectively received in a gentle friction fit relationship. In one embodiment, a cinch-type cord 47 that closes the slot may be included, either to tighten the slot about the dispensing nozzle 14 or to close it entirely if the dispensing nozzle 14 is removed.

At least one handle 39 or strap extends upwardly from the upper portion 30 of the housing 20. Preferably, a pair of fashionable straps extends upwardly, each strap being coupled to a respective side wall 34 by a metal ring (such as a D-ring) and having a pattern complementary to the pattern or indicia on the upper portion 30 itself.

In use, a user may load non-beverage items into the interior area of the upper portion 30 of the housing 20 so as to store or transport them in the normal manner of using a tote bag. In addition, the user insert a wine box bladder 12 or of some other liquid into the compartment 48 through the slit 45 and position the dispensing nozzle 14 through the aperture 46 in the one end wall 43. Once the bladder 12 and dispensing nozzle 14 are positioned, the user may also position the flap 37 to conceal the aperture 46 and dispensing nozzle 14. In this manner, it appears that the user is merely transporting items in a fashionable tote bag.

It is understood that while certain forms of this invention have been illustrated and described, it is not limited thereto except insofar as such limitations are included in the following claims and allowable functional equivalents thereof.

The invention claimed is:

1. A tote bag beverage dispensing apparatus for use with a bladder of liquid having a dispensing nozzle, said beverage dispensing apparatus, comprising:

a housing having an upper portion positioned atop a lower portion so as to substantially conceal said lower portion;

wherein:

said upper portion includes an upper portion bottom wall and a plurality of upper portion side walls extending upwardly from said upper portion bottom wall, said upper portion bottom wall and said upper portion side walls together defining an interior area and an open top allowing access to said interior area through said open top;

said lower portion includes an insulated lower portion bottom wall, a pair of opposed insulated lower portion end walls extending upwardly from said lower portion bottom wall, and a pair of insulated lower portion side walls extending between said pair of lower portion end walls and upwardly from said lower portion bottom wall;

said lower portion bottom wall, said lower portion end walls, and said lower portion side walls define a compartment configured to selectively receive the bladder of liquid;

said lower portion being configured to maintain a temperature of the bladder situated in said compartment;

a respective side wall of said pair of side walls of said lower portion defines a slit extending substantially between said lower portion end walls that is configured to allow access to said compartment, said slit having a dimension sufficient to receive the bladder of liquid therethrough; and a respective lower portion end wall of said lower portion of said housing defines an aperture configured to receive the dispensing nozzle of the bladder of liquid;

said upper portion includes a flap coupled to a lower end of a respective upper portion side wall, said flap having a flexible construction configured to selectively cover said aperture of said lower portion such that said dispensing nozzle is concealed beneath said flap; and wherein said compartment is not accessible from said interior area of said upper portion of said housing, access to said compartment being blocked by said bottom wall of said upper portion.

2. The beverage dispensing apparatus as in claim 1, wherein said upper portion of said housing is constructed of a fabric material that is flexible.

3. The beverage dispensing apparatus as in claim 1, comprising a fastener in communication with said slit and configured to transition said slit between an open configuration allowing access to said compartment and a closed configuration not allowing access to said compartment.

4. The beverage dispensing apparatus as in claim 3, wherein said fastener is a zipper.

5. The beverage dispensing apparatus as in claim 1, comprising at least one handle coupled to upper edges of respective side walls of said upper portion of said housing.

6. The beverage dispensing apparatus as in claim 5, wherein said at least one handle is coupled to said upper edges of said respective side walls of said upper portion of said housing with metal rings.

* * * * *